US008935840B2

(12) United States Patent
Mitchell et al.

(10) Patent No.: US 8,935,840 B2
(45) Date of Patent: Jan. 20, 2015

(54) CONTINUOUS ROTATION LOG TURNER

(75) Inventors: Rory Matthew Mitchell, Delta (CA); Eddie Ying Ho Fong, Delta (CA); Desmond James Price, Delta (CA); Darrin Scott Stanley, Delta (CA); Brian Nels Soderberg, Delta (CA); Philip David Harrison, Delta (CA)

(73) Assignee: Optimil Machinery Inc. (CA)

( * ) Notice: Subject to any disclaimer, the term of this patent is extended or adjusted under 35 U.S.C. 154(b) by 975 days.

(21) Appl. No.: 13/064,343

(22) Filed: Mar. 21, 2011

(65) Prior Publication Data

US 2011/0226385 A1 Sep. 22, 2011

Related U.S. Application Data

(60) Provisional application No. 61/282,711, filed on Mar. 22, 2010.

(51) Int. Cl.
*B27B 31/00* (2006.01)
*B27B 31/04* (2006.01)

(52) U.S. Cl.
CPC ..... *B27B 31/00* (2013.01); *B27B 31/04* (2013.01)
USPC ..... 29/281.1; 144/248.5; 144/356

(58) Field of Classification Search
CPC ..... B27B 31/04
USPC ..... 29/281.1; 144/248.5, 356–357; 414/431, 432
See application file for complete search history.

(56) References Cited

U.S. PATENT DOCUMENTS

| | | | | | |
|---|---|---|---|---|---|
| 2,586,483 | A | * | 2/1952 | Ross | 83/712 |
| 2,694,422 | A | | 11/1954 | Doty | |
| 3,854,614 | A | * | 12/1974 | Albrecht | 414/432 |
| 4,027,769 | A | * | 6/1977 | Hasenwinkle et al. | 198/570 |
| 4,078,651 | A | * | 3/1978 | Ekholm et al. | 198/400 |
| 4,139,035 | A | * | 2/1979 | Bystedt et al. | 144/357 |
| 4,471,823 | A | * | 9/1984 | Wadell | 144/248.5 |
| 4,489,635 | A | * | 12/1984 | Cooper | 83/708 |
| 4,505,377 | A | * | 3/1985 | Sundberg | 198/624 |
| 4,879,659 | A | * | 11/1989 | Bowlin et al. | 700/167 |
| 5,141,038 | A | * | 8/1992 | Nakaya | 144/213 |
| 5,421,385 | A | * | 6/1995 | McGee | 144/357 |
| 2,153,635 | A | | 1/1997 | Mckelvie | |
| 5,622,213 | A | * | 4/1997 | McKelvie | 144/246.2 |
| 5,765,617 | A | * | 6/1998 | Mierau et al. | 144/387 |
| 5,950,517 | A | | 9/1999 | Yoder | |
| 6,026,872 | A | * | 2/2000 | Leitinger | 144/369 |
| 7,007,729 | B1 | * | 3/2006 | Landers | 144/242.1 |
| 2003/0226617 | A1 | * | 12/2003 | Choquette | 144/4 |
| 2009/0000910 | A1 | * | 1/2009 | Perreault | 198/379 |

* cited by examiner

*Primary Examiner* — Lee D Wilson
*Assistant Examiner* — Tyrone V Hall, Jr.
(74) *Attorney, Agent, or Firm* — Antony C. Edwards

(57) ABSTRACT

An elevating and clewing continuous log turner includes a mainframe having a movable frame adapted for vertical or horizontal translation relative to the mainframe. A rotating group is mounted in the movable frame. The rotating group has a passageway therethrough. Roller arms are pivotally mounted around a perimeter of the rotating group. The roller arms concentrically clamp the log relative to the rotating group to thereby rotate the log about its longitudinal axis simultaneously with selective rotation of the rotating group. At least one actuator horizontally and vertically translates the movable frame relative to the mainframe.

23 Claims, 16 Drawing Sheets

Figure 9 PLAN VIEW

ELEVATION VIEW
(ROLLS OPEN)

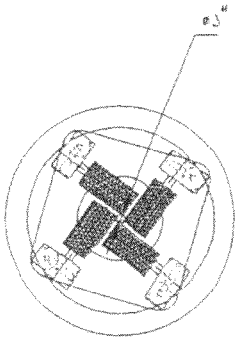
Figure 11 ELEVATION VIEW
(ROLLS CLOSED)

CONTINUOUS ROTATION LOG TURNER

CROSS REFERENCE TO RELATED APPLICATION

This application claims priority from U.S. Provisional Patent Application No. 61/282,711 filed Mar. 22, 2010 entitled Elevating and Slewing Log Turner.

FIELD OF THE INVENTION

This invention relates to the field of log turners for rotating a log about its longitudinal axis as the log is moved along a conveyor so as to optimise its orientation for primary breakdown or the like and in particular to a log turner which allows continuous forward conveying of a stream of logs, while simultaneously turning a log in the stream about the logs longitudinal axis, elevating or lowering the log, or laterally slewing the log.

BACKGROUND OF THE INVENTION

The necessity of turning a log prior to further processing has been a long standing requirement in most log processing machinery. Many types of turners have existed over time. Early ones required the log to stop forward motion during the turning motion. As machine throughput has increased it is more common now to use log turner designs that can turn the log during forward motion—so called flying log turners. One such common log turner was comprised of two opposing vertical spiked rolls that would move up/down opposite to each other such that the linear motion was translated into a rotary turn of the log as it was driven forward by these same spiked rolls. After each turn these rolls would need to reset to a home position in preparation for the next turn cycle. Other flying log turner designs also require this reset to home motion. If such turners do not perform this reset motion in applicant's experience there is a good chance that during the next turn cycle the log turner would run out of linear stroke and the turn would fail. As log processing speeds have increased the time of this 'reset to home' is more and more of a problem since at some point it would limit processing speeds.

Traditional log turners also have not proven to be very accurate when it comes to turning. This is a result of the in-direct nature of the rotation. Although the optimization computer calculates the required angle of turning very accurately this angle must be then recalculated as a distance of linear travel—a calculation based on the diameter of the log. Logs by their nature have highly irregular surfaces making this translation from rotary angle to linear travel not very accurate. To make matters worse there is more potential in these traditional designs for log slippage and the end result was that many logs were not being accurately turned. This then results in the ideal optimization the computer has calculated not being achieved—and then the yield of lumber not being as high as expected. Recent efforts to improve on this have incorporated some form of second scanning measurement of the rotary position along with a second 'corrective' turn but this is an expensive and only partially successful answer to the problem. The present invention by virtue of its X, Y and direct rotary motion provides more accurate positioning of the log in the optimized rotary orientation on the first turn cycle, negating the need for added complexity In the prior art, applicant is aware of U.S. Pat. No. 5,622,213 which issued to McKelvie on Apr. 22, 1997 for a Flying Log Turner. As described by McKelvie, in any processing operation handling logs, the logs are generally carried on conveyor belts between processing equipment that performs specific tasks on the logs, the example given where logs are processed into sawed lumber after being fed past scanning equipment that determines the optimized orientation of the log for maximum recovery from log. McKelvie describes the use in the past of conventional flying vertical rolls, and proposes a flying log turner wherein a rotating group is mounted in a main frame, the housing having a passage therethrough to receive a log from an infeed conveyor, and in which gripping spike rolls are mounted adjacent the passage to grip a log passing through the passage. The spike rolls are mounted on the rotating group for movement with the housing. A drive motor rotates the rotating group through a selected angle to rotate the longitudinal axis of the log held in the spike rolls.

SUMMARY OF THE INVENTION

The log turner according to the present invention rotates successive logs as they are transported downstream for further processing. Prior to arriving AT the log turner the log has been scanned and the data processed to determine the optimum rotary orientation of the log, as well as other processing details needed to optimize recovery of lumber from the log. In the preferred embodiment as the log enters the log turner it is gripped by multiple driven spiked rolls that close to make contact with the log such that they have control over the log's rotary position while at the same time driving the log forward into the downstream machinery. Once the rolls grip the log, an inner ring or cylinder of the log turner rotates a fixed number of degrees about the axis of rotation of the ring or cylinder as determined by the prior scanning and log optimization. The assembly of both the rotating center ring and a movable frame in which the rotating center ring is mounted may be selectively moved and positioned vertically and laterally across the feed direction, that is, Y and X axes respectively to aid in presenting the log to the downstream machinery as prescribed by the log optimization.

In particular the center ring contains multiple for example three or four spiked feedrolls. These feedrolls are driven typically by hydraulic or electric motors to propel the log forward during turning. These rolls are clamped onto the log surface such that they hold the log firmly during the turning motion. Once the center ring of the turner is free to turn without limit then the connections to the center ring required for these motions (electrical or hydraulic typically) from the frame of the log turner machine can no longer be made by conventional means. Prior machines for example would use some form of loop or reel to allow the hoses or wires to deal with these connections. This is fine for one log turn cycle but once the machine is allowed to rotate repeatably in one direction, as likely will happen if sequential logs require such rotation, these connections would reach a physical limit.

The present invention uses an alternative means for the required connections. For example, the present invention may use multiple hydraulic pathways, each path providing the hydraulic fluid for a particular function, such as driving a spike roll or for actuating clamping the rolls on to or retracting the rolls from the log's surface. Alternatively the driving or actuating junctions may be electrically driven. Control signals being sent to the rotating ring via wireless means.

In summary, the elevating and slewing log turner according to the present invention may be characterized in one aspect as including an apparatus for elevating, lowering and laterally slewing a log, that is, perpendicularly to its longitudinal axis, and for simultaneously rotating the log about its longitudinal axis while the log is translating on a conveyor in a flow direction from an upstream side of the log turner apparatus to a downstream side of the log turner apparatus. In particular the apparatus may include a mainframe having a movable frame translatably mounted therein or thereon, the movable frame adapted for vertical or horizontal translation relative to the mainframe. A rotating group is mounted in the movable frame. The rotating group has a passageway therethrough. The passageway is oriented substantially parallel with the infeed flow direction. The axis of rotation of the rotating group is substantially parallel to the infeed flow direction.

Roller arms are pivotally mounted in radially spaced apart array around a perimeter of the rotating group. Each roller arm has a log engaging roller rotatably mounted on its distal end. Each roller arm in the array of roller arms is simultaneously pivotable concentrically about a log passing through the passageway, and concentrically about the axis of rotation of the rotating group to engage against and selectively disengage from the surface of the log when the log is passing through the passageway in the flow direction. Advantageously the rollers on the roller arms are driven rollers which are selectively rotatable by a selectively actuable roller drive. A synchronizer synchronizes pivoting of the roller arms to concentrically clamp the log relative to the rotating group to thereby rotate the log about its longitudinal axis simultaneously with selective rotation of the rotating group about the axis of rotation. A selectively engagable drive cooperates with the rotating group for the selective rotation of the rotating group.

At least one actuator cooperates with the movable frame to selectively simultaneously translate horizontally and vertically the movable frame relative to the mainframe whereby the log may be selectively slewed horizontally and selectively elevated or lowered vertically while translating longitudinally substantially in the flow direction through the passageway.

In one preferred embodiment the movable frame includes first and second sub-frames mounted to each other for translation in a substantially vertical plane relative to one another.

The first sub-frame may be mounted to the second sub-frame for selective translation vertically relative to the second sub-frame. The second sub-frame may be mounted to the mainframe for selective translation horizontally relative to the mainframe.

The actuators for the movable frame may include first and second actuators, wherein the first actuator is rigidly mounted to the first and second sub-frames so as to cooperate therebetween to actuate the vertical translation, and wherein the second actuator is rigidly mounted to the mainframe and the second sub-frame for selective translation of the second sub-frame relative to the mainframe. The first and second sub-frames may be mounted substantially vertically in the mainframe. The mainframe may also be substantially vertical. The first sub-frame may be slidably mounted on a parallel spaced apart pair of vertically extending slides mounted to the second sub-frame. The second sub-frame may be mounted to a parallel spaced apart pair of horizontally extending slides mounted to the mainframe. In one embodiment the vertically extending slides and the horizontally extending slides are pairs of parallel rods, and the sub-frames are slidably mounted to the rods by sliding couplings selectively movable along the rods.

The selectively engagable drive selectively rotates the rotating group by means of a drive train in a preferred embodiment. The drive train has opposite first and second ends, wherein first end of the drive train is engagable with the drive and wherein the second end of the drive train is mounted to the movable frame so as to move therewith relative to the mainframe. In particular, the second end of second drive train may be mounted to the second sub-frame so as to translate to horizontally therewith. The second end of the drive train may also be rotatably coupled to the rotating group for the rotation of the rotating group simultaneously during the vertical translation of the first sub-frame. The rotatable coupling may include a flexible endless loop such as a drive chain, in which case the second end of the drive train preferably includes a toothed drive member such as a gear or sprocket or the like. The drive train may include a drive shaft which is universally coupled between the drive and the toothed drive member.

The sequencer may be a perimeter ring of linkage members pivotally mounted around an outer circumference of the passageway and simultaneously actuable by a roller arm actuator mounted adjacent to the array of roller aims. The sequencer may include bell cranks cooperating between the linkage members and the roller arms, wherein opposite ends of the linkage members are pivotally mounted to ends of the bell cranks, whereby actuation of the roller arm actuator drives the linkage members in an arc around the perimeter of the passageway thereby rotating the bell cranks relative to the rotating group and concentrically translating the rollers relative to the axis rotation of the rotating group. In one embodiment the array of roller arms includes four roller arms substantially equally radially spaced apart about the longitudinal axis of the rotating group.

BRIEF DESCRIPTION OF THE DRAWINGS

FIG. 11 is, in elevation view, the embodiment of FIG. 10 showing the rolls in their closed position.

DETAILED DESCRIPTION OF EMBODIMENTS OF THE INVENTION

Figure 1:
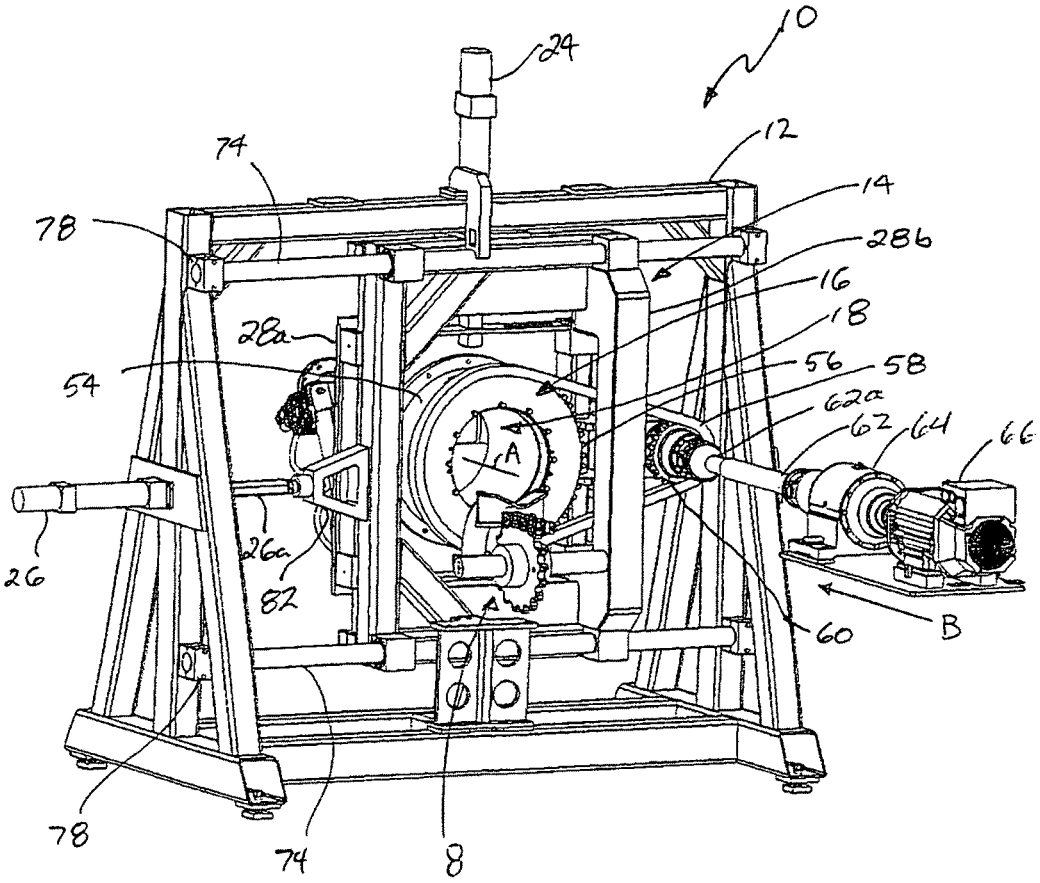
FIG. 1 is a perspective view of the upstream side of the log turner according to the present invention, and with the rolls shown in the closed position.

Log turner 10 includes a mainframe 12 supporting a movable frame 14. Mainframe 12 mounts down onto or sits on a solid ground surface. A rotating group 16 is mounted into moveable frame 14. Rotating group 16 is hollow so as to define a central passageway 18 therethrough which may as illustrated advantageously be cylindrical and having an axis of symmetry collinear with an axis of rotation A which extends generally parallel to an infeed direction B for the infeeding of logs 6 on an infeed conveyor 8.

A radially spaced apart array of roller arms 20 are mounted around the rotating group 16. Preferably the array is equally radially spaced apart about axis A. In particular, each roller arm 20 is mounted to, for rotation with, rotation of rotating group 16 about axis A. Each roller arm 20 is also pivotable about its corresponding pivot axis C. Pivot axes C are parallel to axis of rotation A. Roller arms 20 include pressrolls or rolls 22 which, in a preferred environment, are driven rollers as better described below. Rolls 22 on roller arms 20, engage a log 6 which is passing through passageway 18, clamping the exterior surface of the log between the radically spaced apart array of rolls 22 by the pivoting of roller arms 20 about axes C. With a log clamped in rolls 22, the log may be simultaneously driven in direction B so as to draw, or in the alternative embodiment of FIGS. 9-11 both draw and push, the log through central passageway 18 while also simultaneously the log may be rotated about its longitudinal axis by the active rotation of rotating group 16 about axis of rotation A. Simultaneously still, moveable frame 14 may be translated vertically so as to be elevated or lowered by means of selective actuation of vertical actuator 24 and may be translated horizontally so as to be laterally clewed by the selective actuation of horizontal actuator 26, or a combination of simultaneous vertical and horizontal translation. The vertical translation is by the movement of sub-frame 28*a* which is slidably mounted on, for vertical translation relative to, sub-frame 28*b*. Sub-frame 28*b* is slidably mounted for horizontal translation on mainframe 12 as better described below.

In the illustrated embodiments, which are not intended to be limiting, a group of four roller arms 20 are mounted on one or both ends of rotating group 16 for simultaneous pivoting of rolls 22 in direction D so as to concentrically pinch or clamp rolls 22 towards, or to retract rolls 22 away from, axis of rotation A passing through central passageway 18. A synchronizer, as better described below, coordinates the simultaneous pivoting of the roller arms in direction D.

Advantageously, rolls 22 may be spike rolls, and, in one preferred embodiment, rolls 22 are driven by motors 30 which may be hydraulic motors fed by hydraulic lines 32. Hydraulic lines 32 may be mounted to manifolds 34, themselves mounted to a support plate 36. Support plate 36 is mounted to so as to become part of, and for rotation with, rotating group 16. Hydraulic fluid is pumped to motors 20 via a rotating coupling as would be known to one skilled in the art.

Shafts 38 are mounted to, so as to extend orthogonally cantilevered rigidly from, support plate 36 so that shafts 38 extend parallel to axis of rotation A. Sleeves 40 are slidably mounted over shafts 38. Sleeves 40 have splines 40*a* at their distal ends opposite to their base ends 40*b*. Ends 40*b* are rigidly mounted to collars 40*c*.

Earlier feed roll designs incorporated a hydraulic wheel motor mounted inside the roll. The wheel motor was mounted to a housing which pivoted on the torsion coupling sleeve. This prior art design was flawed due to the centrifugal force created by the rotation of the rotating group. As the cantilevered mass of the feed roll was all on one side of the pivot shaft, the centrifugal force would overpower the closing force of the roll and allow the log to slip causing rotation errors. In the present invention the pivot housing has a through-drive shaft. The hydraulic motor is flange mounted with the motor and its housing on one side of the pivot shaft. The feed roll is mounted on an extended drive shaft on the opposite side of the pivot shaft. This design balances the load equally on both sides of the fulcrum, negating the effect of the centrifugal forces generated by the rotating group.

By way of one example of the roller arm synchronizer, which is not intended to be limiting, a circumferentially extending array of linkage arms 42 extend around the perimeter of support plate 36 so as to thereby extend around the opening of central passageway 18. The ends of linkage arms 42 are pivotally mounted to collars 40*c* by bell cranks 44. Each bell crank 44 is pivotally mounted on its opposite sides to the corresponding ends of the adjacent pair of linkage arms 42. Thus when linkage arms 42 are driven in direction E by actuator 46, bell cranks 44 and thereby sleeves 40 are rotated in direction D.

Roller arms 20 are mounted onto sleeves 40 so as to rotate simultaneously in direction D with rotation of bell cranks 44. In particular, housings 20*a* are mounted over and along sleeves 40 so as to mount splined couplers 20*b* onto splines 40*a* on the distal ends of sleeves 40. Housings 20*a* and couplers 20*b* rigidly support sleeves 48, through which are mounted roller drive shafts 50. Drive shafts 50 are mounted by means of bushings or the like journalled in and along sleeves 48 for free rotation relative thereto. Drive shafts 50 are mounted to motors 30 so that actuation of motors 30 drives drive shafts 50 in rotation about axis of rotation F. Rolls 22 are mounted onto drive shafts 50 for rotation about axis of rotation F simultaneously with rotation of the drive shafts.

In one preferred embodiment, not intended to be limiting, rotating group 16 includes a cylindrical drum unit 52 which is rotatably mounted through an aperture formed in sub-frame 28*a*. Annular bearing support 54 supporting annular bearings 54*a* is rigidly mounted in the aperture in sub-frame 28*a*. Advantageously bearing support 54 has a depth perpendicular to the plane of sub-frame 20*a* so as to support the length of drum unit 52. Thus annular bearing support 54 may itself be a rigid drum mounted to, so it's to extend orthogonally from, sub-frame 28*a* and in particular where, as shown, sub-frame 28*a* includes a plate.

A large drive sprocket 56 is mounted at and around the upstream end of rotating group 16, and in particular is mounted to the upstream end of drum unit 52. A drive chain 58 is mounted around sprocket 56 and extends around a smaller driven sprocket 60. Driven sprocket 60 is mounted on the distal end of a drive shaft 62, itself mounted by means of universal joints 62*a* at the opposite ends thereof so as to extend between driven sprockets 60 and transmission 64. A motor 66 is coupled to transmission 64. Thus the selective rotation of driven shaft 62 by the selective engagement of transmission 64, rotates driven sprocket 60 thereby driving drive chain 58 around sprocket 56 to selectively rotate drum unit 52. Rotating group 16 is thereby selectively rotated about axis of rotation A.

Sub-frame 28*a* may in one embodiment, not intended to be limiting, be mounted for vertical sliding translation relative to sub-frame 28*b* by the sliding of slider blocks 68. Slider blocks 68 may contain sliding collars, bearings or the like through which are slidably journalled a parallel vertically extending pair of rods 70, themselves rigidly mounted onto sub-frame 28*b* by means of for example clamping couplers 72.

The upper and lower ends of sub-frame 28*b* may be slidably mounted for horizontal translation on a parallel pair of horizontally extending rods 74. Sub-frame 28*b* may be slidably mounted onto rods 28 by another set of slider blocks 76, which in the manner of slider blocks 68, may include internally sliding collars (not shown), bearings or the like mounted within the slider blocks. The opposite ends of rods 74 are mounted for example by means of clamping couplers 78 to mainframe 12.

Actuator 24 may be rigidly coupled to sub-frame 28*a* by means of rod 24*a* which is rigidly mounted to the sub-frame by, for example, a crossbeam or flange 80. Crossbeam or flange 80 extends between, and is rigidly mounted to, the upper horizontally spaced apart pair of slider blocks 68, themselves rigidly mounted to the upstream side of the plate of sub-frame 28*a*.

Horizontal actuator 26 drives horizontal translation of sub-frame 28*b* by means of rod 26*a* mounted to one of the vertical supports of sub-frame 28*b* by means of, for example, mounting bracket 82.

Thus with the use of the vertical and horizontal actuators and their corresponding vertically and horizontally translatable sub-frames, a log which has been engaged by the rolls 22 on roller arms 20 may be elevated or lowered and simultaneously horizontally translated, that is, slewed relative to the log conveyors while the log is passing through passageway 18 in direction B and while the log is being rotated about its longitudinal axis.

In operation, while upstream of rotating group 16, a log 6 is scanned to determine the X-Y location and leading end diameter of the log on the conveyor. The pressroll opening, i.e. the diameter of the opening between rolls 22 when in their selectively opened position in the passageway is sized to match the leading end diameter of the log plus three inches. The movable sub-frames 28*a* and 28*b* are positioned to align the opening between the rolls 22 with the X-Y center of the leading end of the log. As the log advances the rolls 22 close on the log and the log is then lifted to create room for the horns 6*a* of the log to rotate in direction G down towards the conveyor 8, both upstream and downstream of the log turner 10. Then, simultaneously with raising and turning the log, the log is moved to the system centerline so as to be aligned with a positioning infeed (not shown) downstream of the log turner. While continuing the turning of the log, the log is fed into the positioning infeed. Once the log is in position to be placed on the sharp chain of the positioning infeed, the log turner lowers the trailing end of the log down to the sharp chain. Rolls 22 then open and thumper rolls (not shown) in the positioning infeed impale the log on the sharp chain.

Resilient material (not shown) is mounted to provide a torsional spring between each roll 22 itself and the corresponding roll assembly including drive shafts 50. The resilient material may be made from polyurethane, which allows some give between the assembly and the roll. The resilient material is intended to provide about 5 degrees of resilient rotation (about 2 inches of movement) to the roll 22 and as a result buffers the system from shocks caused by the rolls being in contact with, and following irregularities in the log surface. Urethane or rubber rated between 60 A and 70 A durometer will work. Steel springs may also be used. The resilient material provides torsional stiffness in the range of 1900 lb.in./deg/(1.12E+02 lb.in./rad), for durometer 70 A, to as low as 1600 lb.in./deg. for durometer 60 A.

To get the optimized piece count rates the rotary speed of the center ring when turning must be very high. This fast rotary motion had proven to create issues with prior rotary log turner designs, largely that the driven spiked rolls would tend to loose grip as they were fighting against the centrifugal force of the roll as the inner ring rotates.

Figure 9:
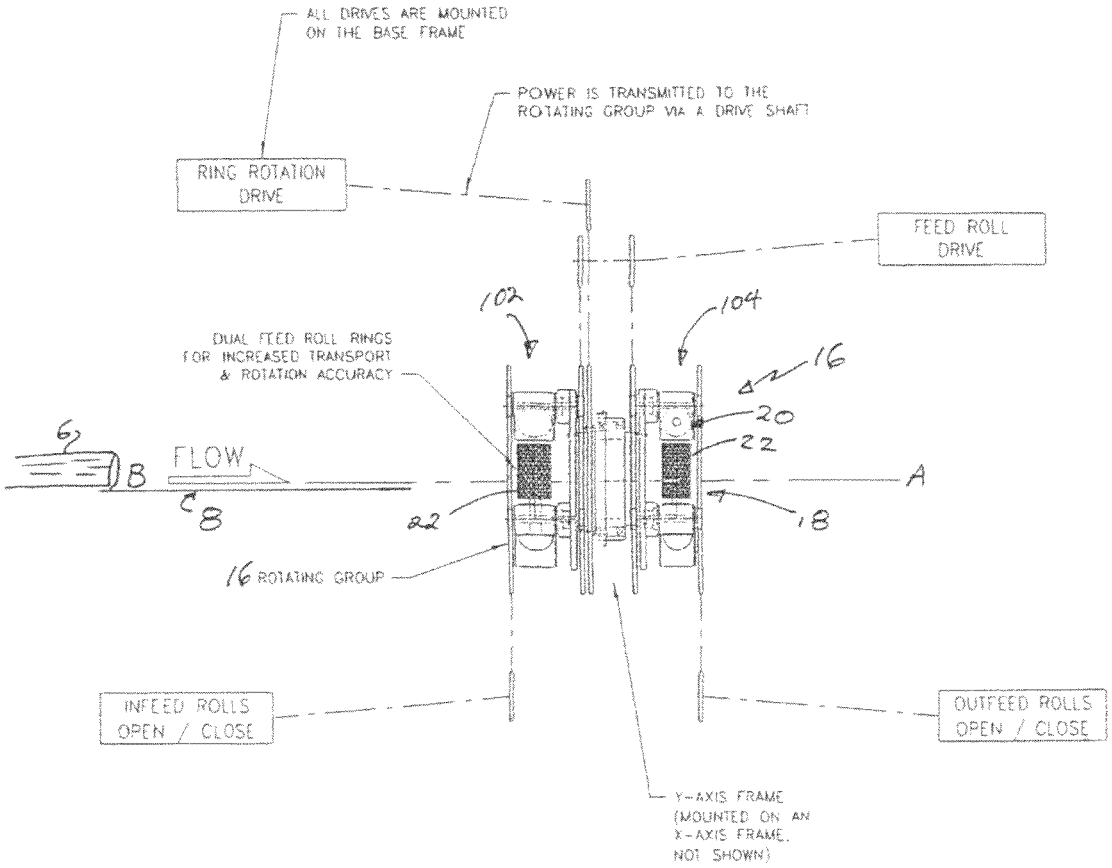
FIG. 9 is, in plan view, an alternative electro-mechanical embodiment of the invention.
Figure 10:
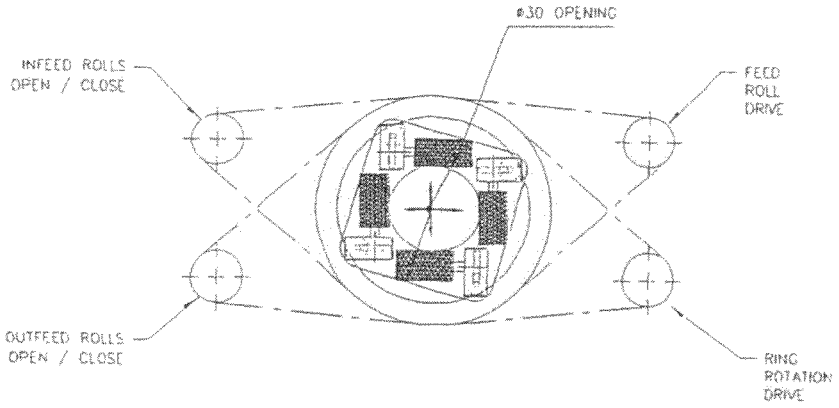
FIG. 10 is, in elevation view, the embodiment of FIG. 9 showing the rolls in the open position.

In an electro-mechanical embodiment of the log turner, as seen in FIG. 9-11 a larger product envelope is provided as compared to the hydraulic embodiment of FIGS. 1-8. Current hydraulic seal technology limits the practical diameter of the rotating sleeve in rotating group 16 to approximately 24", (which accommodates a 20" product envelope. Servo drives position all the control devices on the stationary base frame. By controlling the rotational speed of the rotating ring drive relative to open/close drives, the function of opening and closing the feed rolls 22 is achieved without the requirement of a linear actuator 46 and linkage 42. As well, by controlling the rotational speed of the ring drive relative to the feed roll drive driving rolls 22, the log transport velocity can be controlled. Having this control capability at the base frame location reduces cost.

A dual feed ring embodiment is illustrated in FIG. 9. In the direction of flow B, the first or upstream feed ring 102 is positioned close to the conveyor 8. This allows feed ring 102 to take control of the log 6 transport sooner, reducing the risk of log movement relative to its upstream scanned location. Movement of the log between its upstream scanned position and the log turner transport is one of the greatest causes of log rotation error. As the log passes into the second or downstream feed ring 104, the press rolls 22 are closed on the log providing increased transport control as the rolls bump over knots and irregular surfaces.

Short logs traveling at high speeds limit the amount of time for the rotating group 16 to rotate the log to its optimized position as determined by an optimizer processor solving for optimized solutions based on the scanned data from the upstream scan. By closing the pressrolls of the first feed ring on the log and initiating the turning of the log, and next closing pressrolls of the second feed ring on the log while continuing the turn, then opening the pressrolls of the first ring before the end of the log arrives in the first ring, the distance between the rings 102 and 104 is additive to the effective contact length on the log.

The remote ring drive reduces inertia of rotating group 16 and hence provides energy savings. It also allows for continuous turning of the rotating group, meaning that when the first log is released, the log turner can close on the next log from the current position. There is no requirement for the log turner to have to return to a home position. This reduces the total accumulated travel of the rotating group by an estimated 50%, thereby increasing the life of the equipment. By not requiring time to travel to a home position between logs, the end gap between logs can be minimized, thereby increasing production capability.

Figure 2:
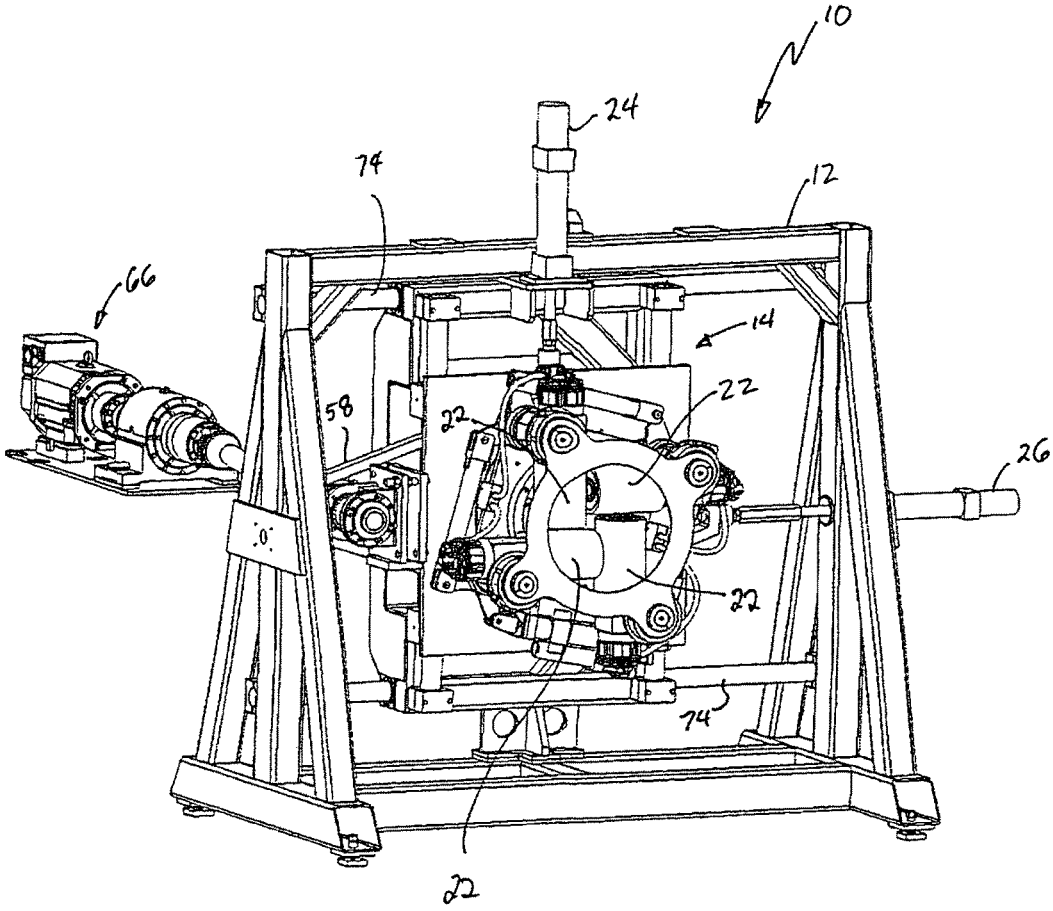
FIG. 2 is a perspective view of the log turner of FIG. 1 from the downstream side.
Figure 2A:
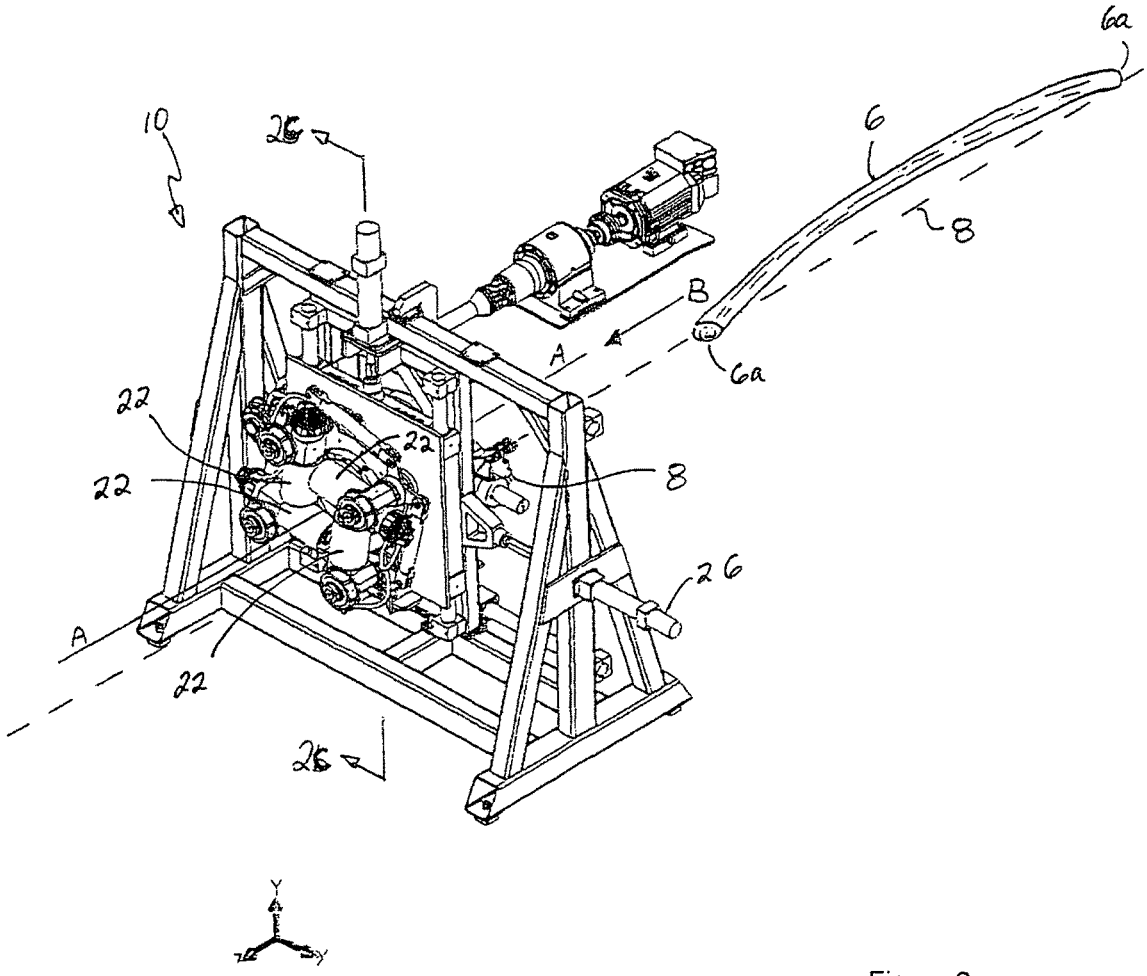
FIG. 2*a* is a further perspective view from the downstream side of the log turner of FIG. 2 illustrating a log being translated in its flow direction into the upstream side of the log turner, and with the rolls opened to a first preset position.
Figure 2B:
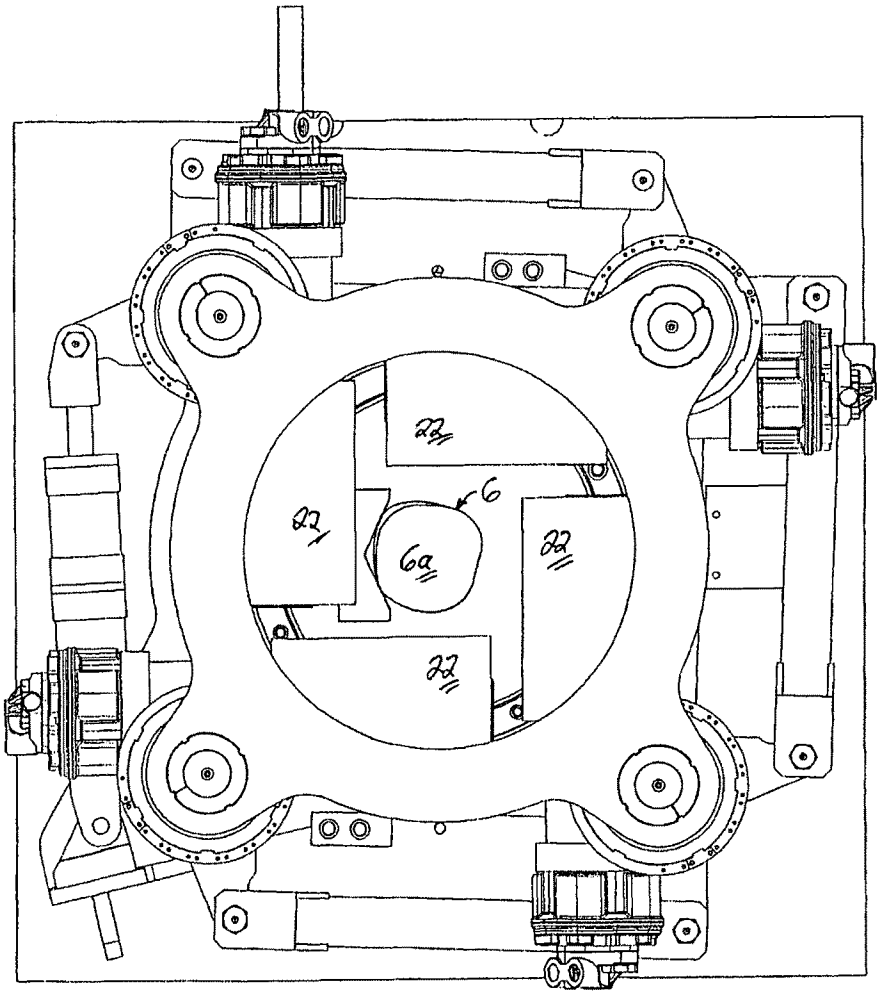
FIG. 2*b* is, in elevation view from the upstream side, the log turner of FIG. 2*a*, showing the rolls in a preset position to act as a bedroll to support the leading end of an incoming log into the log turner.
Figure 2C:
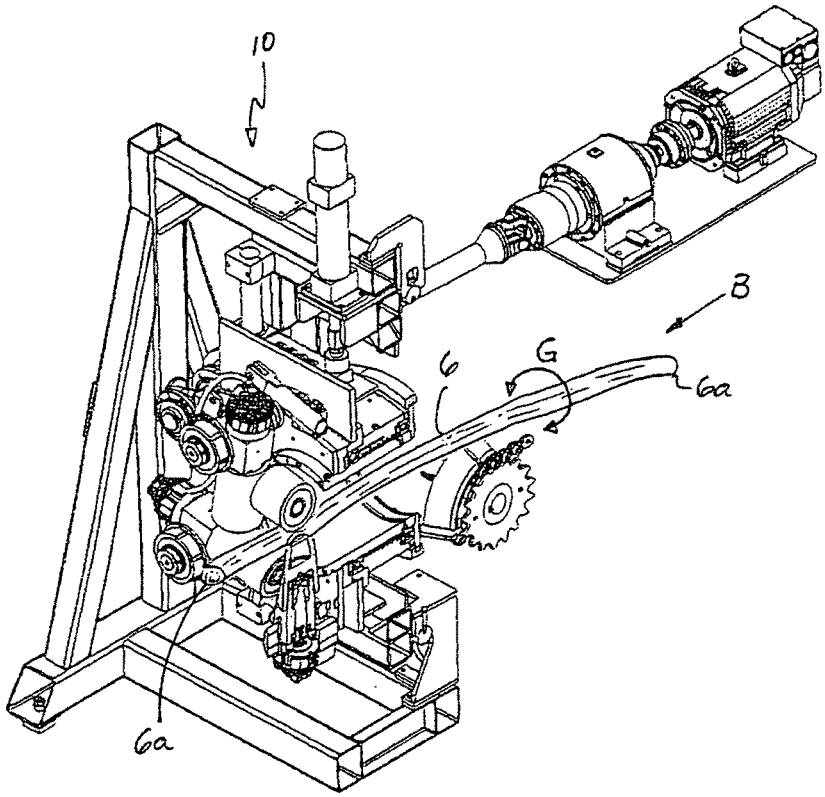
FIG. 2*c* is a section view along line 2*c*-2*c* in FIG. 2*a* showing the log clamped in the log turner for rotation of the log.
Figure 3:
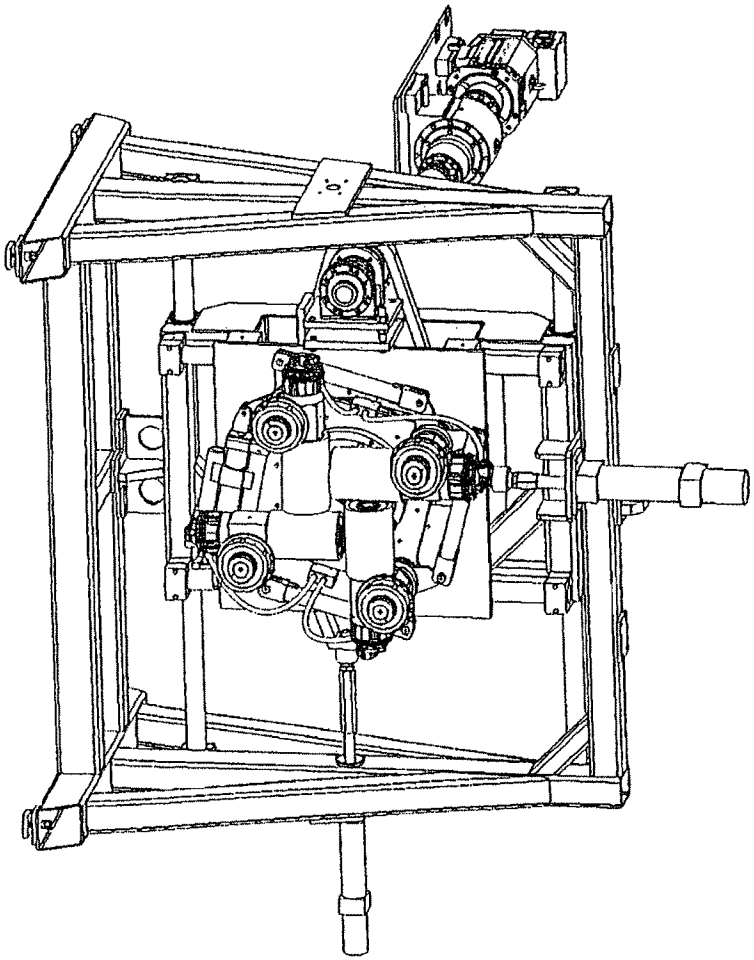
FIG. 3 is the perspective view of FIG. 2 with a downstream-most cover removed to show the array of roller arms and corresponding rolls in their fully concentrically inwardly pivoted position so as to occlude the exit from the passageway through the rotating group.
Figure 3A:
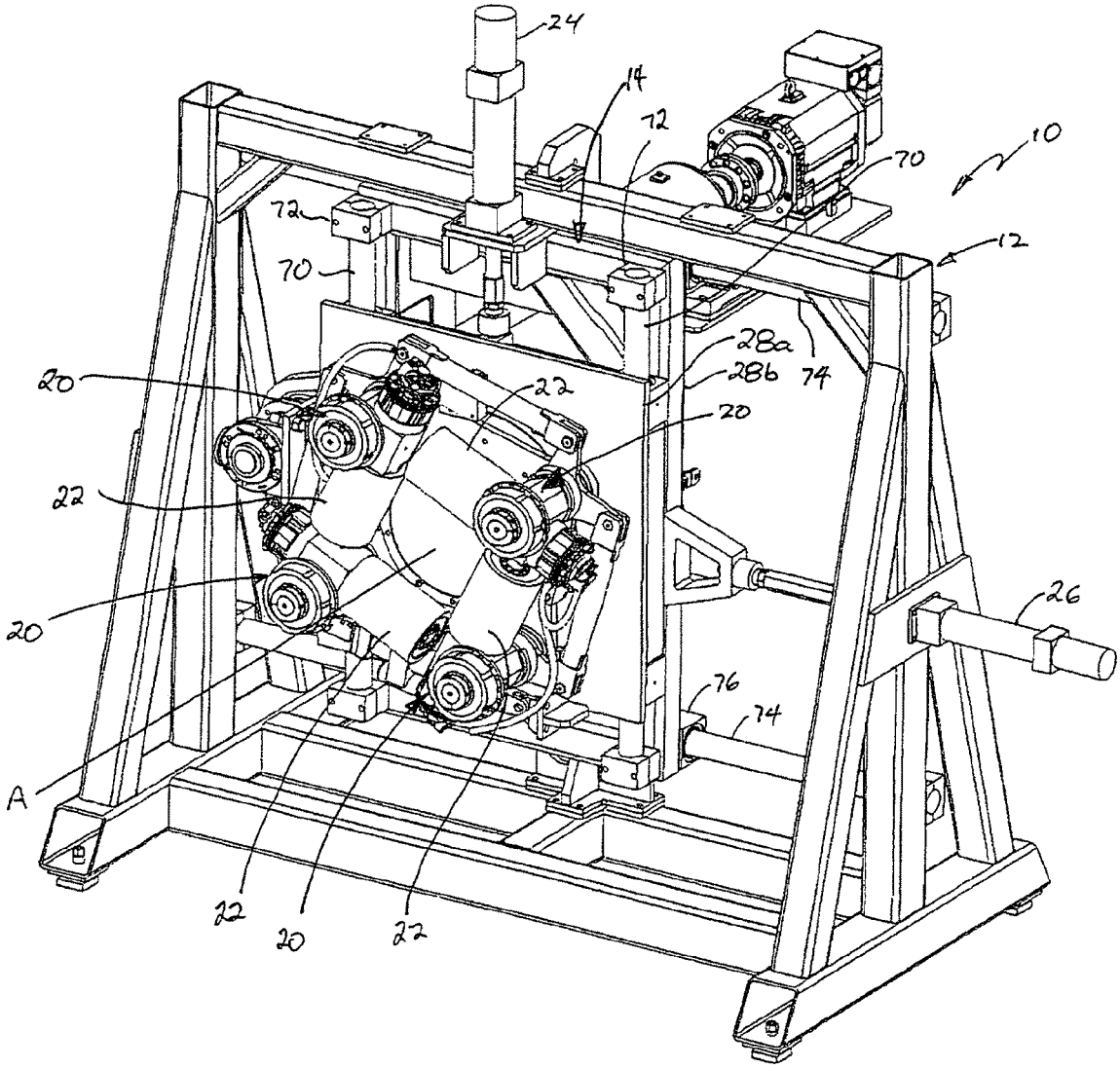
FIG. 3*a* is the view of FIG. 3 as seen from the right hand side to better illustrate the coupling between the movable frame and the horizontal actuator, and showing the rolls fully open.
Figure 4:
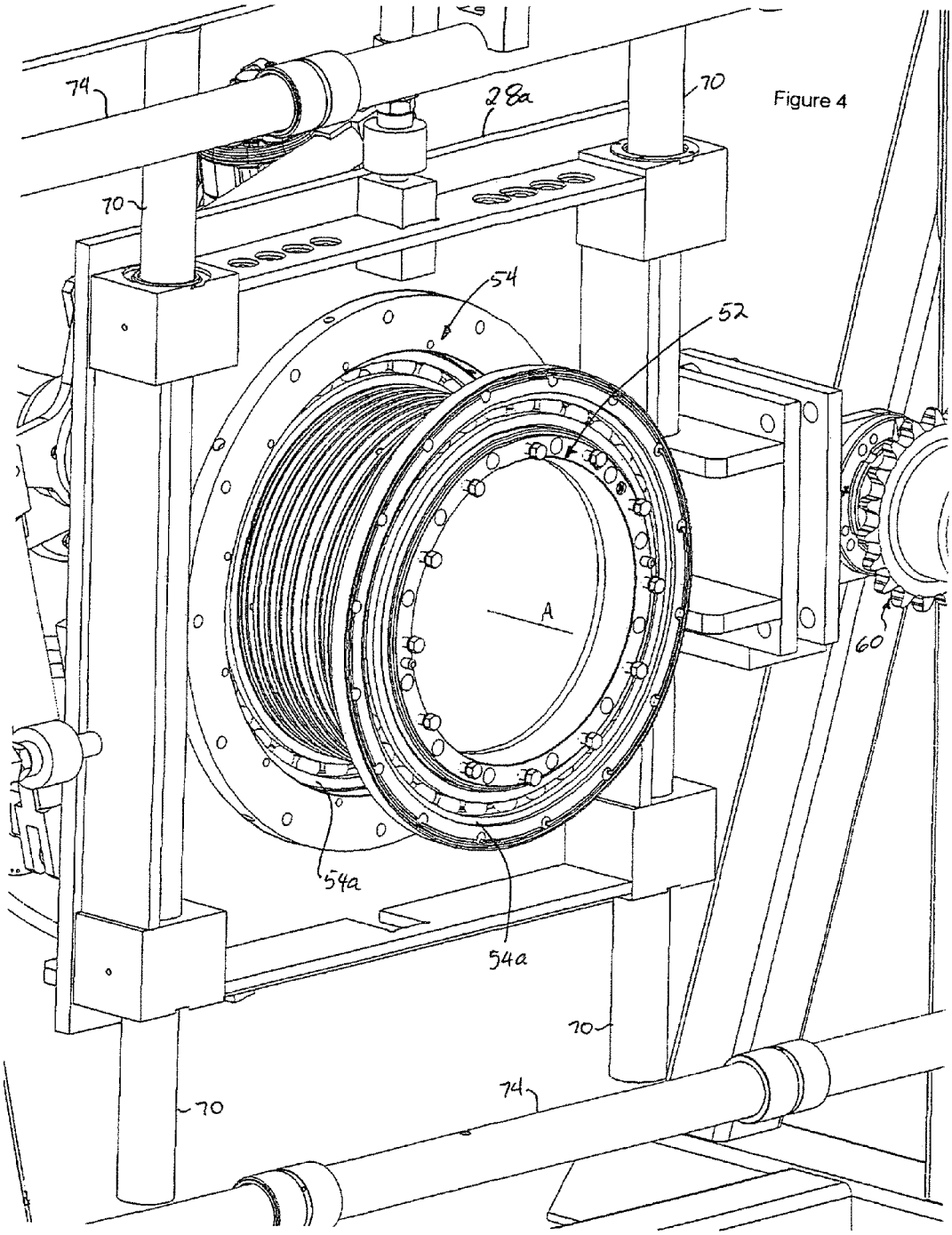
FIG. 4 is an enlarged partially cut-away view of the view of FIG. 1 showing the upstream side of the rotating group with the outer drum removed and with a sub-frame member, the rotation drive, and the infeed conveyor removed to better see the inner rotating drum of the rotating group.
Figure 5:
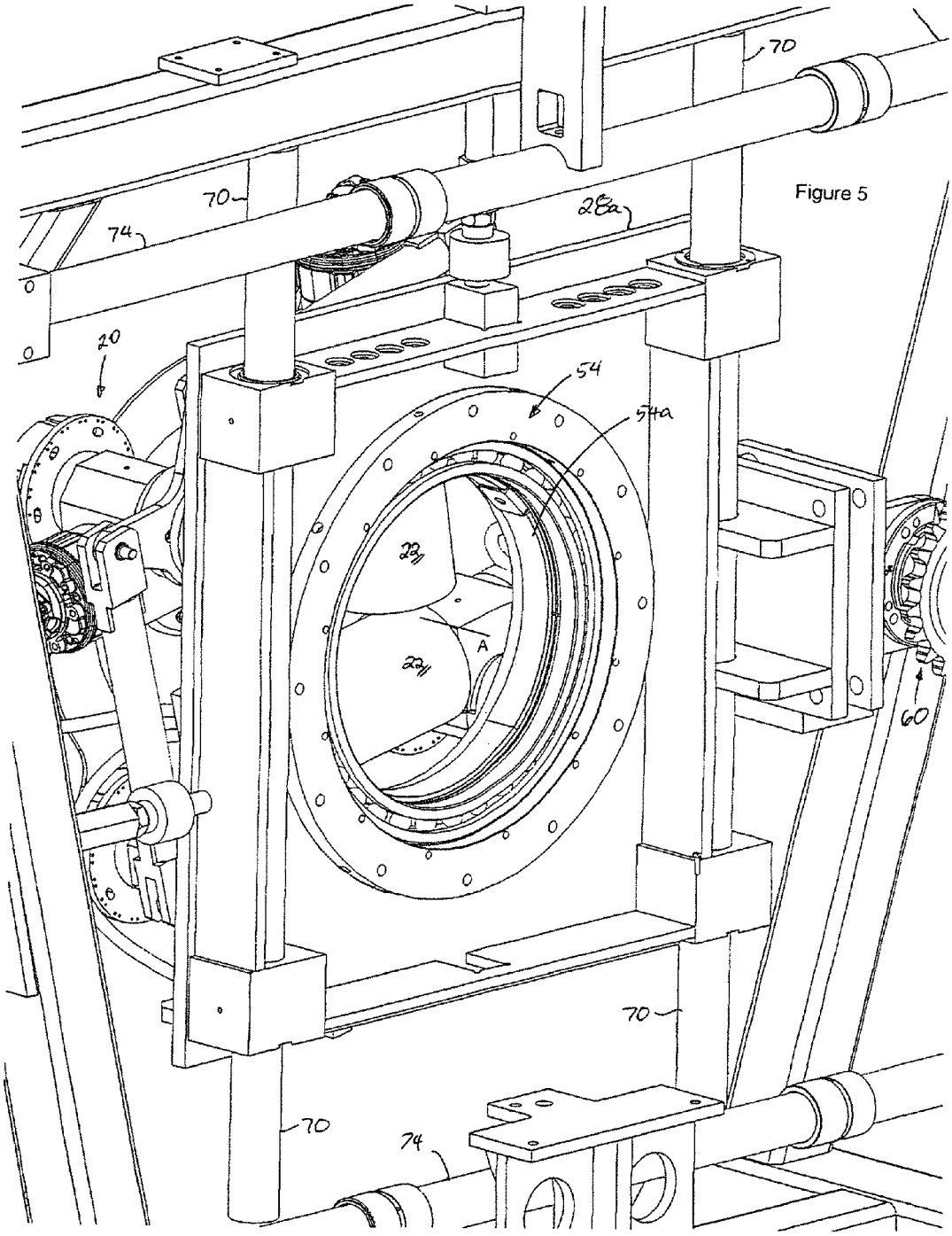
FIG. 5 is a further partially cut-away view of the view of FIG. 4 with the inner drum of the rotating group removed to better see the aperture through the movable frame.
Figure 5A:
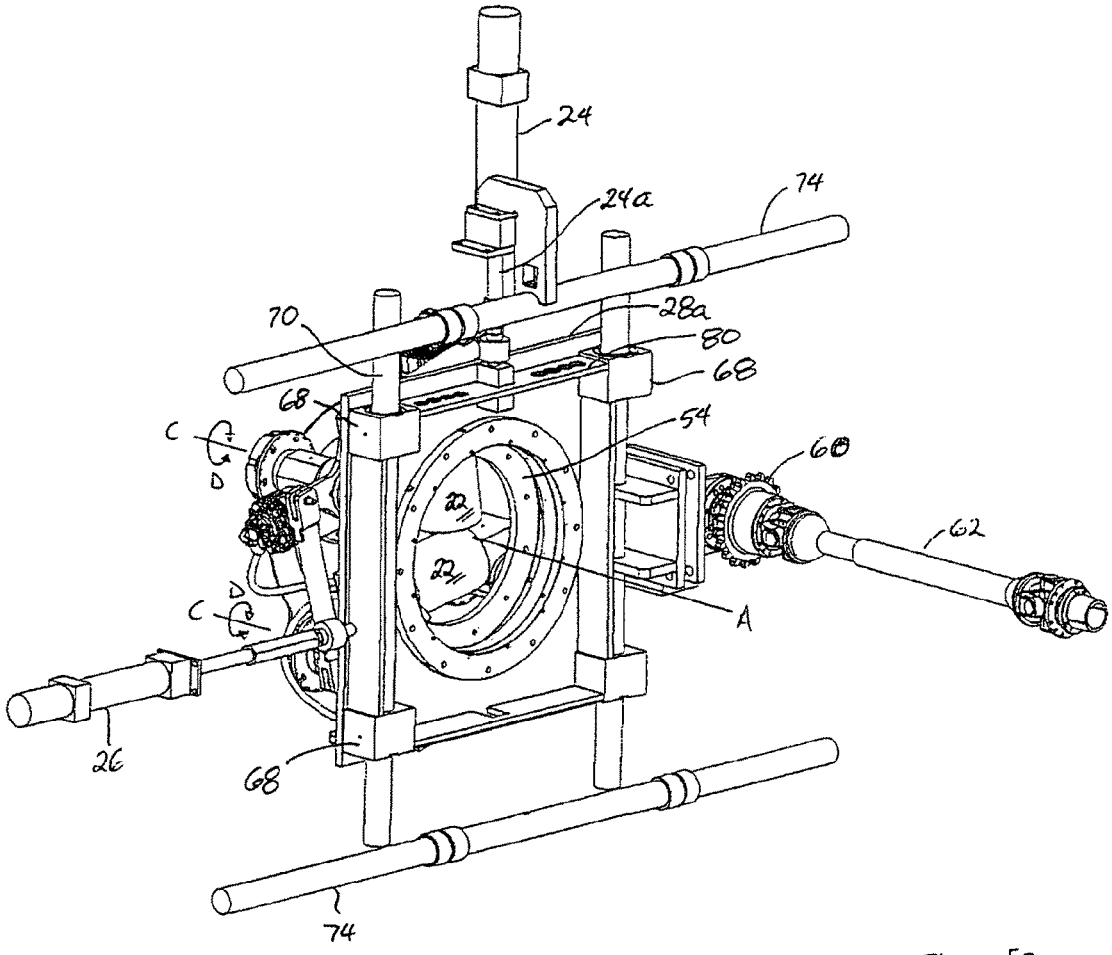
FIG. 5*a* is, in further cut-away view, the view of FIG. 5 with the mainframe and part of the movable frame removed.
Figure 6:
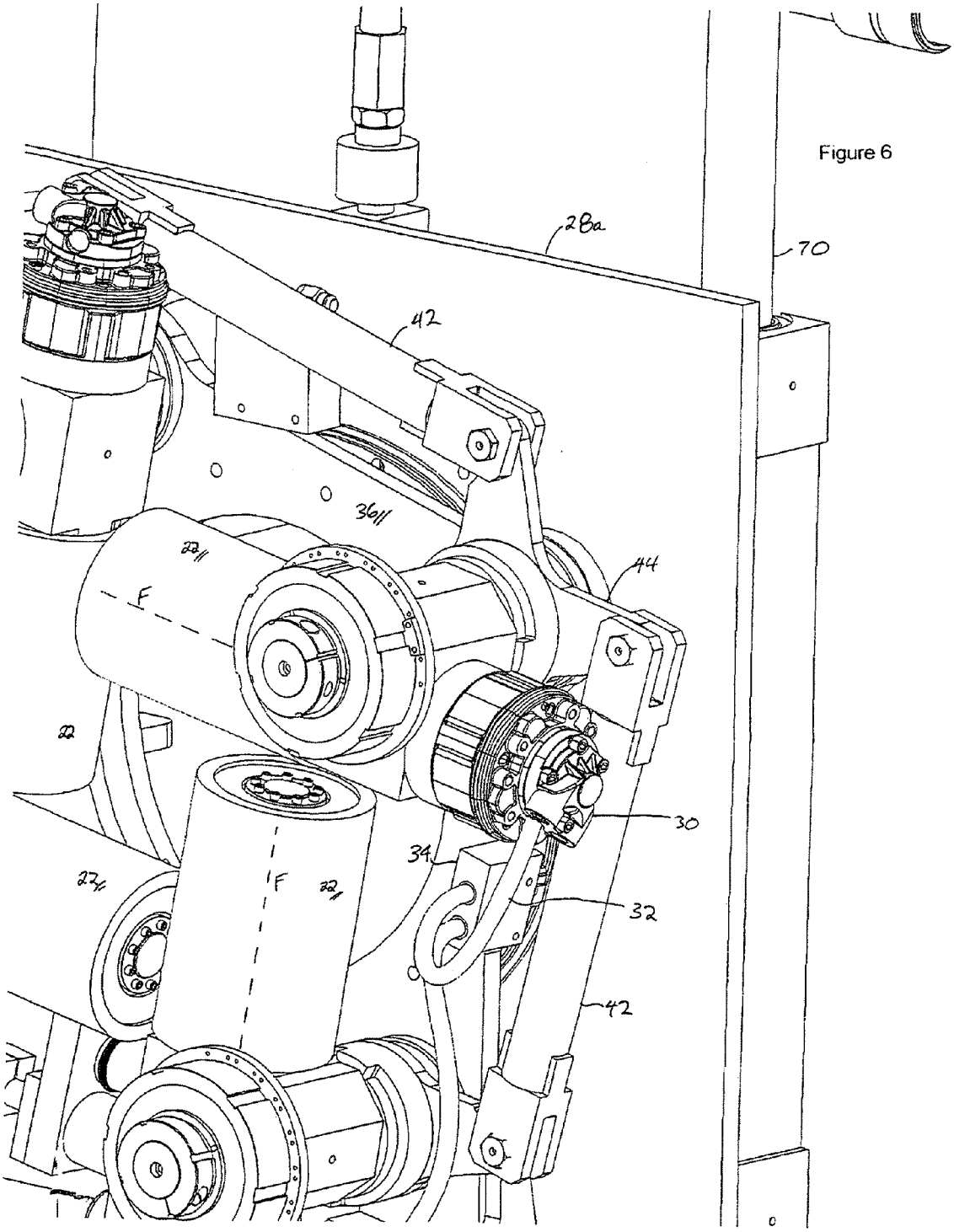
FIG. 6 is an enlarged partially cut-away view of the view from the downstream side of the view of FIG. 5.
Figure 7:
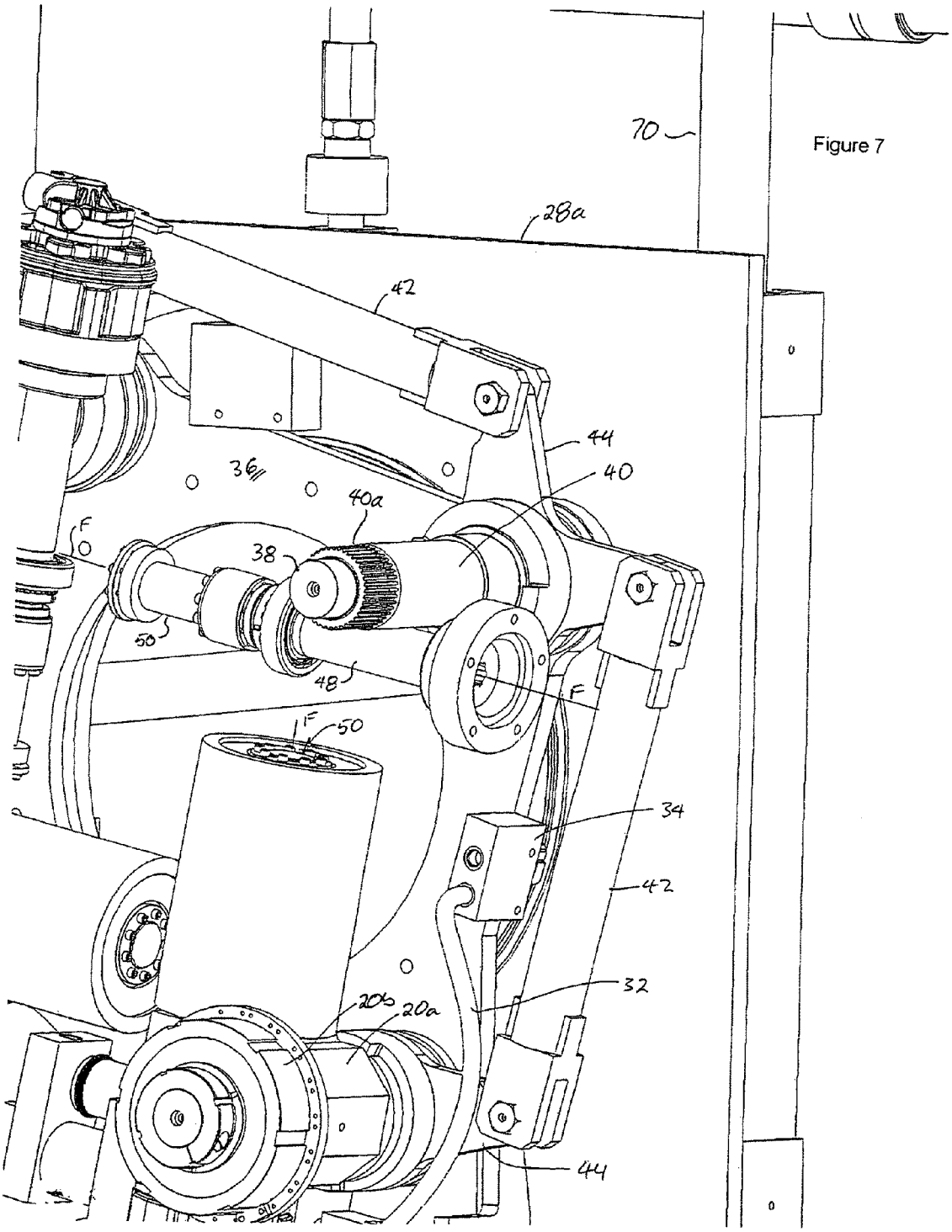
FIG. 7 is the view of FIG. 6 with one of the rollers and corresponding roller arm housing removed.
Figure 8:
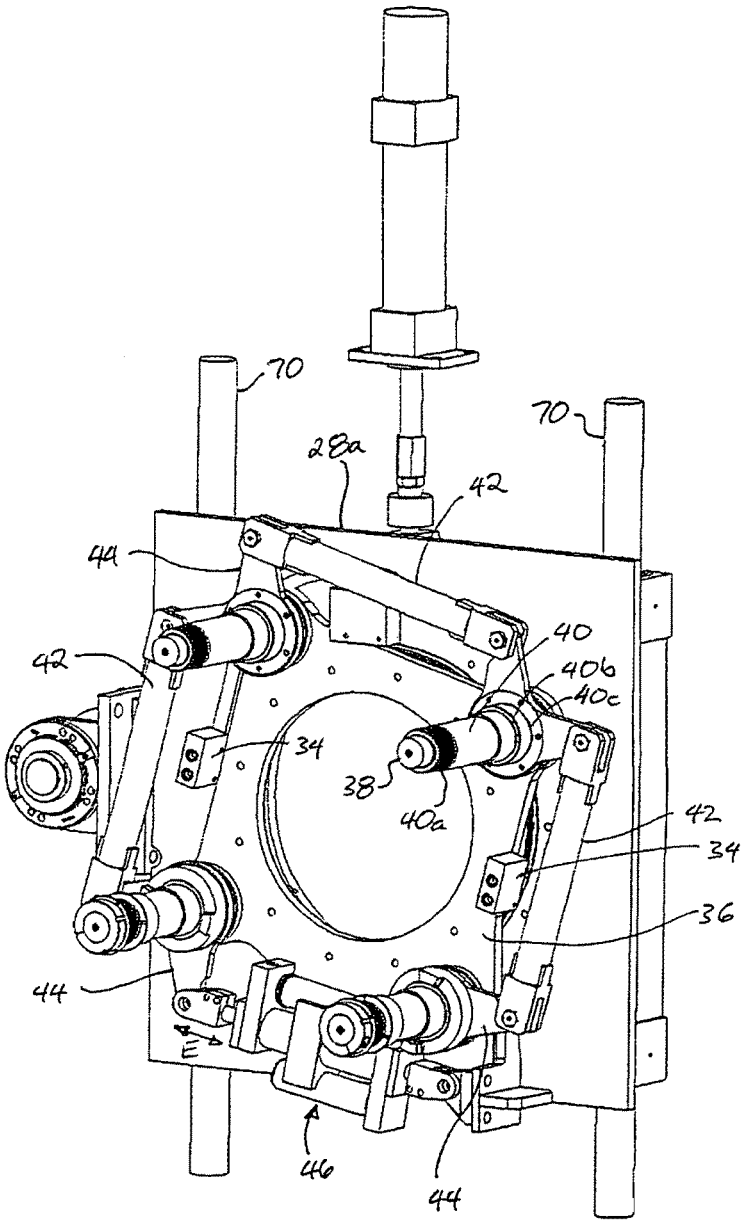
FIG. 8 is the view of FIG. 7 showing the downstream face of the vertically translatable sub-frame and with the roller arms and their corresponding rollers removed.

That being said, in both the hydraulic and electro-mechanical embodiments it can be advantageous after a log exits the log turner 10 to, where time and gap between logs allows, reset the elevation and/or horizontal position to the extent necessary, and, as time or gap between logs allows, to simultaneously move the lowermost feedroll 22 into a horizontal lower-most position to act as a bedroll for the next incoming log into the log turner as seen in FIG. 2*b*. This smoothes the log's entry into the log turner and reduces the opportunity for the log to loose position during the hand-off from the in-feed conveyor to the log turner. After the previous, i.e. downstream, log is discharged, the log turner ring moves in either direction to move the lowest roll 22 to a horizontal position to act as a bedroll supporting the incoming log until the rolls 22 close. This minimizes log movement on the infeed chain after the scan and prior to the rolls 22 closing on the log.

Regarding the remote feed roll drive, by mechanically positioning the feed roll drive on the stationary base frame, the feedback encoder that closes the speed control loop can be mounted on the drive instead of attempting to communicate across the rotary joint. The feed rolls are attached to a 90° gear reducer which is mounted on the rotating ring by means of a swivel connection. There are four feed roll assemblies mounted on the front and rear flanges of the rotating ring. The four assemblies on each flange are inter-connected with a drive sprocket. The sprocket has internal teeth which engage the input drive sprockets to the gear reducers. The sprocket has external teeth which are driven by the feed roll drive. The feed roll drive has a jackshaft which drives both the infeed and outfeed sprockets simultaneously.

While the rotating group is parked so as to provide lineal feed only, the feed roll drive may change speed relative to transport devices before or after i.e. upstream or downstream of log turner 10 to alter the gap between logs. When the log is being rotated and transported lineally simultaneously, the velocity of the feed roll drive is compounded by the velocity of the ring drive. Rotating clockwise while feeding forward, the velocity of the ring drive would be added to the velocity of the feed roll drive to maintain a constant feed speed. Rotating counter-clockwise while feeding forward, the velocity of the ring drive would be subtracted from the velocity of the feed roll drive to maintain a constant feed speed. The use of the servo drives with closed loop control, provide the accuracy required between the multiple drives.

Regarding the remote feed roll open/close, the feed roll gear reducer has an additional external gear attached to the housing. Similar to the sprocket which drives the input gear, a second sprocket connects the four gear reducer housings. By altering the velocity between the ring drive and the open/close drive, the gear reducers rotate in their respective swivel mounts causing the rolls to open or close. Rotating clockwise while feeding forward, the velocity of the ring drive would be added to the velocity of the feed roll open/close drive to close the rolls on a log or subtracted to open. Rotating counter-clockwise while feeding forward, the velocity of the ring drive would be subtracted from the velocity of the feed roll open/close drive to close the rolls on a log or added to open. The use of servo drives with closed loop control, provide the accuracy required between the multiple drives. As the rolls close and come in contact with the log, the drive stalls (except for the correctional velocity relative to the ring drive) and maintains a constant torque which determines the clamping force on the log.

Due to the fact there are four rolls in each group, the gear reducer open/close gears are attached to the reducer housing via a torsion coupling. This allows +/−5° relative motion between each of the rolls in their assembly, which is approximately +/−1" at each roll contact point on the log. As logs are not a perfect circular shape, the torsion couplings allow the contact points of the rolls on a log to form a non-circular pattern from a single drive. The infeed feed roll open/close and the outfeed feed roll open/close assemblies have individual drives for sequencing the rolls on and off the log independently.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A log turner apparatus for elevating, lowering and slewing a log perpendicularly to its longitudinal axis and for simultaneously rotating the log about its longitudinal axis while the log is translating in a flow direction from an upstream side of the log turner apparatus to a downstream side of the log turner apparatus, the apparatus comprising:

a mainframe having a movable frame translatably mounted thereon and adapted for vertical or horizontal translation relative to said mainframe;

a rotating group mounted in said movable frame wherein said rotating group has a passageway therethrough and wherein said passageway is oriented substantially parallel with said infeed direction;

a radially spaced apart array of roller arms pivotally mounted in radially spaced apart array around a perimeter of said rotating group wherein each roller arm of said array of roller arms has a log engaging roller rotatably mounted on the distal end of said each roller arm and wherein said each roller arm in said array of roller arms are simultaneously pivotable concentrically about the log and concentrically about an axis of rotation of said rotating group to engage and selectively disengage the log when passing through said passageway in the flow direction, and wherein said axis of rotation of said rotating group is substantially parallel to the flow direction, and wherein a synchronizer synchronizes pivoting of said roller arms in said array of roller arms to concentrically clamp the log relative to said rotating group to thereby rotate the log about its longitudinal axis simultaneously with selective rotation of said rotating group about said axis of rotation;

a selectively engagable drive cooperating with said rotating group for said selective rotation of said rotating group;

at least one actuator cooperating with said movable frame to selectively simultaneously translate horizontally and vertically said movable frame relative to said mainframe whereby the log is correspondingly slewed horizontally and elevated or lowered vertically while translating longitudinally substantially in the flow direction through said passageway.

2. The apparatus of claim 1 wherein said movable frame includes first and second sub-frames mounted to each other for translation in a substantially vertical plane relative to one another.

3. The apparatus of claim 2 wherein said first sub-frame is mounted to said second sub-frame for selective translation vertically relative to said second sub-frame, and wherein said second sub-frame is mounted to said mainframe for selective translation horizontally relative to said mainframe.

4. The apparatus of claim 3 wherein said at least one actuator comprises first and second actuators, wherein said first actuator is rigidly mounted to said first and second sub-frames so as to cooperate therebetween to actuate said vertical translation, and wherein said second actuator rigidly mounted to said mainframe and said second sub-frame for selective translation of said second sub-frame relative to said mainframe.

5. The apparatus of claim 4 wherein said first and second sub-frames are mounted substantially vertically in said mainframe wherein said mainframe is also substantially vertical.

6. The apparatus of claim 5 wherein said drive selectively rotates said rotating group by means of a drive train, and wherein said drive train has opposite first and second ends, wherein first end of said drive train is engagable with said drive and wherein said second end of said drive train is mounted to said movable frame so as to move therewith relative to said mainframe.

7. The apparatus of claim 6 wherein said second end of second drive train is mounted to said second sub-frame so as to translate to horizontally therewith, wherein said second end of said drive train is also rotatably coupled to said rotating group for said rotation of said rotating group simultaneously during said vertical translation of said first sub-frame.

8. The apparatus of claim 7 wherein said rotatable coupling includes a flexible endless loop.

9. The apparatus of claim 8 wherein said flexible endless loop is a drive chain and wherein said second end of said drive train includes a toothed drive member.

10. The apparatus of claim 9 wherein said drive train includes a drive shaft universally coupled between said drive and said toothed drive member.

11. The apparatus of claim 10 wherein said rollers of said roller arms are driven rollers selectively rotatable by a selectively actuable roller drive.

12. The apparatus of claim 11 wherein said sequencer is a perimeter ring of linkage members pivotally mounted around an outer circumference of said passageway and simultaneously actuable by a roller arm actuator mounted adjacent said array of roller arms.

13. The apparatus of claim 12 wherein said sequencer further includes bell cranks cooperating between said linkage members and said roller arms, and wherein opposite ends of said linkage members are pivotally mounted to ends of said bell cranks whereby actuation of said roller arm actuator drives said linkage members in an arc around said perimeter thereby rotating said bell cranks relative to said rotating group and said concentrically translating said rollers relative to said axis rotation of said rotating group.

14. The apparatus of claim 13 wherein said array of roller arms includes four said roller arms substantially equally radially spaced about said longitudinal axis of said rotating group.

15. The apparatus of claim 14 wherein said first sub-frame is slidably mounted on a parallel spaced apart pair of vertically extending slides mounted to said second sub-frame, and wherein said second sub-frame is mounted to a parallel spaced apart pair of horizontally extending slides mounted to said mainframe.

16. The apparatus of claim 15 wherein said vertically extending slides and said horizontally extending slides are pairs of parallel rods and wherein said sub-frames are slidably mounted to said rods by sliding couplings selectively movable along said rods.

17. The apparatus of claim 1 further comprising:

a second radially spaced apart array of roller arms pivotally mounted in radially spaced apart array around a perimeter of said rotating group and spaced from the first said array of roller arms, wherein each roller arm of said second array of roller aims has a log engaging roller rotatably mounted on the distal end of said each roller arm and wherein said each roller arm in said second array of roller arms are simultaneously pivotable concentrically about the log and concentrically about an axis of rotation of said rotating group to engage and selectively disengage the log when passing through said passageway in the flow direction, and wherein said axis of rotation of said rotating group is substantially parallel to the flow direction, and wherein a second synchronizer synchronizes pivoting of said roller arms in said second array of roller arms to concentrically clamp the log relative to said rotating group to thereby rotate the log about its longitudinal axis simultaneously with selective rotation of said rotating group about said axis of rotation.

18. The apparatus of claim 1 wherein said log engaging rollers include at least one driven roller selectively driven by a selectively actuable roller drive, and wherein a corresponding said roller arm corresponding to said at least one driven roller includes a pivot housing pivotally mounted about a fulcrum, and wherein said driven roller is mounted to said housing on a radially inner side of said fulcrum, radially inner towards said passageway, and wherein said roller drive is mounted to said housing on an outer side of said fulcrum, opposite to said inner side, so as to substantially balance loading about said fulcrum, whereby an effect of centrifugal force acting on said at best one driven roller generated by said rotation of said rotating group is reduced.

19. The apparatus of claim 18 wherein said roller drive is a motor mounted substantially in-line with an axis of rotation of said roller, and wherein said fulcrum is offset from said axis of rotation.

20. The application of claim 18 wherein said roller drive is a motor mounted substantially in-line with an axis of rotation of said roller, and wherein said fulcrum includes a shaft mounted substantially orthogonally to said axis of rotation.

21. A method for continuously turning a log includes the steps of:

(a) providing a log turner for elevating, lowering and slewing a log perpendicularly to its longitudinal axis and for simultaneously rotating the log about its longitudinal axis while the log is translating in a flow direction from an upstream side of the log turner to a downstream side of the log turner, wherein the log turner comprises:

(i) a mainframe having a movable frame translatably mounted thereon and adapted for vertical or horizontal translation relative to said mainframe;

(ii) a rotating group mounted in said movable frame wherein said rotating group has a passageway therethrough and wherein said passageway is oriented substantially parallel with said infeed direction;

(iii) a radially spaced apart array of roller arms pivotally mounted in radially spaced apart array around a perimeter of said rotating group wherein each roller arm of said array of roller arms has a log engaging roller rotatably mounted on the distal end of said each roller arm and wherein said each roller arm in said array of roller arms are simultaneously pivotable concentrically about the log and concentrically about an axis of rotation of said rotating group to engage and selectively disengage the log when passing through said passageway in the flow direction, and wherein said axis of rotation of said rotating group is substantially parallel to the flow direction, and wherein a synchronizer synchronizes pivoting of said roller arms in said array of roller arms to concentrically clamp the log relative to said rotating group to thereby rotate the log about its longitudinal axis simultaneously with selective rotation of said rotating group about said axis of rotation;

(iv) a selectively engagable drive cooperating with said rotating group for said selective rotation of said rotating group;

(v) at least one actuator cooperating with said movable frame to selectively simultaneously translate horizontally and vertically said movable frame relative to said mainframe whereby the log is correspondingly slewed horizontally and elevated or lowered vertically while translating longitudinally substantially in the flow direction through said passageway, (b) translating said movable frame so as to position said passageway to substantially align with an incoming leading end of an incoming log, (c) closing said array of roller arms around said leading end once in said passageway so as to hold said incoming log in said log engaging rollers fixed relative to said rotating group, (d) simultaneously rotating said rotating group and driving said log engaging rollers to, respectively rotate the incoming log to an optimized orientation substantially about the incoming log's longitudinal axis and translate the incoming log downstream, (e) simultaneously elevate and slew said movable frame to position the leading end of the incoming log for smooth transition to an out-feed from said log turner and into an infeed of a next downstream machine center.

22. The method of claim 21 further comprising the step of translating said movable frame as the incoming log passes through said passageway so as to lower a trailing end of the incoming log down onto said in feed of the next downstream machine center.

23. The method of claim 21 further comprising the step of positioning said rotating group between adjacent logs exiting and entering said rotating group while simultaneously positioning a lower-most said log engaging roller so as to provide said lower-most log engaging roller as a bedroll for supporting the incoming leading end of the incoming log.

* * * * *